US011879713B2

(12) United States Patent
Huber et al.

(10) Patent No.: US 11,879,713 B2
(45) Date of Patent: Jan. 23, 2024

(54) INSERT MADE OF A TEXTILE FABRIC

(71) Applicants: Nitrochemie Aschau GmbH, Aschau (DE); Teccno Tex GmbH, Höchst (AT)

(72) Inventors: Alexander Huber, Grosskarolinenfeld (DE); Andreas Hämmerle, Hochst (AT); Jens Oltmanns, Waldkraiburg (DE); Ulrich Focken, Waldkraiburg (DE); Walter Lebacher, Aschau am Inn (DE)

(73) Assignees: Nitrochemie Aschau GmbH, Aschau (DE); Teccno Tex GmbH, Höchst (AT)

( * ) Notice: Subject to any disclaimer, the term of this patent is extended or adjusted under 35 U.S.C. 154(b) by 685 days.

(21) Appl. No.: 17/038,796

(22) Filed: Sep. 30, 2020

(65) Prior Publication Data

US 2021/0207933 A1 Jul. 8, 2021

(30) Foreign Application Priority Data

Oct. 4, 2019 (DE) ..... 202019105499.9

(51) Int. Cl.

| | |
|---|---|
| ***F42B 5/192*** | (2006.01) |
| ***F42B 5/18*** | (2006.01) |
| ***D04B 1/16*** | (2006.01) |
| ***D04B 1/22*** | (2006.01) |

(52) U.S. Cl.

CPC ..... *F42B 5/192* (2013.01); *D04B 1/16* (2013.01); *D04B 1/225* (2013.01); *F42B 5/181* (2013.01); *D10B 2201/02* (2013.01); *D10B 2331/10* (2013.01); *D10B 2507/00* (2013.01)

(58) Field of Classification Search

CPC .. F42B 5/18; F42B 5/188; F42B 5/192; F42B 5/181; D04B 1/16; D04B 1/225

USPC ..... 102/431, 432

See application file for complete search history.

(56) References Cited

U.S. PATENT DOCUMENTS

| | | | | |
|---|---|---|---|---|
| 3,218,907 A | | 11/1965 | Beal et al. | |
| 3,474,702 A | | 10/1969 | Remaly et al. | |
| 3,747,532 A | * | 7/1973 | Berger | F42B 5/16 102/282 |
| 3,769,873 A | | 11/1973 | Abel | |

(Continued)

FOREIGN PATENT DOCUMENTS

| | | |
|---|---|---|
| DE | 3008996 A1 | 9/1981 |
| DE | 3008999 A1 | 9/1981 |

(Continued)

OTHER PUBLICATIONS

The extended European search report for Application Np. 19201561, dated Mar. 26, 2020, pp. 1-5, European Patent Office, Germany.

(Continued)

*Primary Examiner* — James S Bergin

(74) *Attorney, Agent, or Firm* — McAndrews, Held & Malloy, Ltd.; Christopher P. Singer; Michael S. Tomsa

(57) ABSTRACT

The disclosure relates to an insert (5) made of a textile fabric for being received in a jacket wall of a cylindrical case (6) made of a combustible, felted fibrous material, wherein in particular embodiments the textile fabric includes one, several, or a plurality of yarns which along a longitudinal direction (L) of the insert form a plurality of mesh rows (18) which each include a plurality of meshes (19, 20, 21) that extend in a circumferential direction (U) of the insert.

18 Claims, 3 Drawing Sheets

(56) References Cited

U.S. PATENT DOCUMENTS

| | | | | |
|---|---|---|---|---|
| 5,050,406 | A | 9/1991 | Strauss et al. | |
| 5,243,914 | A | 9/1993 | Penner | |
| 11,118,874 | B2 * | 9/2021 | Huber | D04H 1/76 |

FOREIGN PATENT DOCUMENTS

| | | | |
|---|---|---|---|
| EP | 3643826 | A1 | 4/2020 |
| WO | 2011/015346 | A2 | 2/2011 |

OTHER PUBLICATIONS

The extended European search report for Application No. 20197743.6, dated Feb. 4, 2021, pp. 1-8, European Patent Office, Germany.
Office action for Application No. 20197743.6, dated Apr. 28, 2022, pp. 1-7, European Patent Office, Germany.

* cited by examiner

INSERT MADE OF A TEXTILE FABRIC

PRIORITY

This application claims the benefit of priority to German utility model patent application no. 20 2019 105 499.9, filed Oct. 4, 2019, which is incorporated herein by reference in its entirety.

FIELD

The invention relates to an insert made of a textile fabric for being received in a jacket wall of a cylindrical case made of a combustible, felted fibrous material.

BACKGROUND

Cases as part of ammunition for firearms have long been known. They serve to receive the propellant powder, which generally is present in granular form. Usually, cases have a circular-cylindrical and oblong hollow shape; the cylinder wall of the case here is referred to as jacket wall.

Combustible cases are burnt or consumed as a result of firing. When this occurs sufficiently free from residues, no case rests need to be removed before the next shot. Ideally, what must be ejected only is a metallic bottom attached to the outside of the case.

It is known to manufacture combustible cases from nitrocellulose and cellulose, in general with additives such as binder resin and stabilizers. For manufacture, a screen mold is vertically or horizontally dipped into an aqueous pulp comprising nitrocellulose and cellulose. By means of negative pressure, the screen mold sucks in the fibrous pulp. There is formed a wet fleece, usually referred to as "raw felt", which represents the precursor of the jacket wall. The fleece or the raw felt is compressed and at least temporarily also heated to achieve the final geometry of the jacket wall and to extract water, whereby the case becomes dimensionally stable.

Due to the nature of the combustible material, the case nevertheless is fragile. If it falls to the ground or abuts against a solid object during handling, this can lead to the formation of cracks in the jacket wall or to the complete breakage of the case. When the case is properly filled with propellant powder, this is no longer tolerable, as exiting propellant powder quite obviously represents an enormous safety risk.

For this reason, various proposals to reinforce the jacket wall of the case by an embedded insert and thereby decrease the fragility have existed for a long time. For example, it is known from WO 2011/015346 A1 to wrap a large-meshed net made of cotton yarn into the jacket wall obtained when preparing the pulp. The net wrapped in several layers sufficiently increases the strength of the case to such an extent that the formation of cracks in the jacket wall or even a complete breakage of the case by bumping or falling down virtually is excluded. However, the manufacturing method is expensive and the thickness of the jacket wall is high, which—at a given outside diameter—makes the usable volume of the case for receiving propellant powder smaller than would be possible without a multilayer reinforcing insert.

SUMMARY

Against this background it is the object of the invention to provide an improved insert which provides for a case that is safe to handle and nevertheless can do with a comparatively thin jacket wall.

This object is achieved by an insert with the features of claim 1. Advantageous embodiments are subject-matter of the dependent claims and of the following description.

According to one embodiment, there is proposed an insert made of a textile fabric for being received in a jacket wall of a cylindrical case made of a combustible, felted fibrous material. The textile fabric is formed as knitwear, hence in particular includes one, several or a plurality of yarns which along a longitudinal direction of the insert form a plurality of mesh rows which each include a plurality of meshes that extend in a circumferential direction of the insert.

The textile fabric is a knitwear that is constructed of a natural fiber yarn and a natural fiber-plastic blended yarn. Preferably, the textile fabric has only one layer. According to one embodiment, the insert made of knitwear consists of a knitted, woven and/or crocheted fabric.

Because of its high tear strength, the natural fiber according to one embodiment is cotton. Because of its high stretchability, the plastic material according to one embodiment is polyurethane or includes polyurethane.

To suitably combine the tear strength and the stretchability, the natural fiber yarn according to one embodiment has a proportion, in particular a yarn content and/or a weight content, of 30% to 50% in the textile fabric and/or the natural fiber-plastic blended yarn has a proportion, in particular a yarn content and/or a weight content, of 50% to 70% in the textile fabric. In particular, the proportions are 50 to 50.

To precisely adjust the stretchability, the natural fiber-plastic blended yarn according to one embodiment has a content of natural fiber from 70% to 95%, especially between 70% and 95%, and/or a content of plastic fiber from 5% to 30%, especially between 5% and 30%. In particular, the shares are 89 to 11.

According to one embodiment, the insert constitutes a hose which in particular in an unstretched state has a diameter of from 40 mm to 155 mm, especially between 40 mm and 155 mm, in order to be extended to typical cartridge diameters with a low elongation. In particular, the hose is fabricated seamless, for example on a circular knitting machine.

To ensure a high tear strength of the insert, the mutually associated meshes of the adjacent mesh rows according to one embodiment are each guided on the same radial side of the hose of the insert and/or adjacent meshes of a mesh row in principle are guided on different radial sides.

To be able to reliably retain typical geometries of propellant powder in cartridges in case of breakage, the fabric according to one embodiment has a mesh row density of from 10 to 13, especially between 10 and 13, mesh rows per centimeter and/or a wale density or a mesh density of from 10.5 to 13.5, especially between 10.5 and 13.5, meshes or wales per centimeter.

According to one embodiment, the insert is stretchable. According to one embodiment, the insert is formed in one layer and is stretchable both axially and radially.

Preferably, the fabric has a maximum elongation/stretchability of about 420% in the circumferential direction of the hose, and a maximum elongation/stretchability of about 80% in the longitudinal direction of the hose. With these elongation/stretchability values, a reliable containment of the propellant powder can remain ensured in the case of breakage of typical cartridges.

According to one embodiment, it is provided to embed the insert in the jacket wall of the case. This is in contrast to the previous tradition of increasing the strength of the jacket wall by means of the insert. With an insert according to one embodiment of the invention the mechanical damage of the jacket wall is permitted and the insert now has the function to for instance keep occurring cracks and fracture openings in the jacket wall closed against the exit of propellant powder, of which it is capable due to its stretchability. This provides for a low thickness of the jacket wall case in two ways. The mechanical strength which the jacket wall has from the outset without taking account of an insert can be assumed to be lower than previously, as cracks and fractures are permissible. And the insert itself likewise can be comparatively thin, as it is not meant to reinforce the jacket wall, but only to retain the bulk powder in the interior of the case.

The stretchability of the insert is to be dimensioned such that it can fulfill this function, i.e. the bridging of cracks and other fracture openings by expansion, without reaching its elongation at break. The elongation/stretchability parameters correct in this sense can be determined empirically, e.g. by standardized drop tests which have previously been used to check the breaking strength of the known cases. Tests already carried out by the applicant with cases according to the invention have shown that the sufficient stretchability of the insert in the longitudinal direction of the case is more important than the stretchability in circumferential direction.

Preferably, the stretchability of the insert is achieved by forming the same as knitwear and quite preferably as a woven, knitted and/or crocheted fabric. Here, the stretchability is the result of the thread guidance.

Because the insert must of course also be combustible, the same normally consists of cotton yarn. However, the same is not stretchable itself. When the yarn is also meant to contribute to the stretchability, cotton yarn is wholly or partly replaced by a polyurethane-cotton blended yarn. Such a blended yarn is commercially available. It regularly has a core of polyurethane which is sheathed by cotton.

In the interest of keeping the thickness of the jacket wall small, there is preferred an insert which consists of only one layer of the knitwear. It was found that the single-layer form is sufficient to safely prevent the exit of bulk powder through fracture gaps and other fracture openings in the jacket wall.

Based on empirically gained findings, the arrangement of the insert in its center, based on the wall thickness of the jacket wall, is optimal. But an arrangement in the wall area located further inwards also is possible without significantly impairing the retaining function. Such an arrangement can be due to the manufacture.

In the embodiment preferred for all forms of the insert, the insert is formed as an expandable hose whose middle axis in the embedded state coincides with the middle axis of the case. The hose preferably is fabricated seamless. Suitable expandable hoses are industrially manufactured as knitwear, in particular as a woven, crocheted and/or knitted fabric, and are commercially available.

The use of tubular inserts enormously simplifies the manufacture of cases according to the invention. In connection with the above-mentioned manufacturing method the expandable single-layer hose is expanded after building up the raw felt to an e.g. medium wall thickness and is drawn over the raw felt built up to this extent in the axial direction of the screen mold. Subsequently, the raw felt is built up further until the final thickness is reached and is then compressed as usual and cured by heating.

To obtain an insert which radially is as thin as possible, and hence to have more space for propellant powder at a given diameter, the insert according to one embodiment is of the single-layer type and is both axially and radially stretchable. In one type of insert, the textile fabric must be biaxially stretchable to absorb cracks/fractures etc. of the case and hence provide for both an axial and a radial elongation.

According to one embodiment, the insert includes at least two or three layers, of which a first layer is at least axially stretchable and a second layer is at least radially stretchable. As a result, less expensive textile fabrics can be used, which must each be stretchable only in terms of one axis.

In the present case, a radial stretchability of the insert in particular is understood to be a stretchability of the insert in a circumferential direction of the insert, in particular when the insert has a tubular shape or another, in particular cylindrical or partly cylindrical hollow shape. The correspondence of the two terms in particular results from the application of a tubular insert: When the hose is radially stretched, this stretchability in particular is provided by an elongation of the insert in its circumferential direction.

Depending on the material used, and possibly depending on the processing of the material into a suitable knitwear, the insert according to different embodiments is stretchable due to a macroscopic elasticity of a material of the insert and/or due to a meshing of a knitwear of the insert.

With regard to the choice of material for the insert experiments have revealed that the insert expediently includes at least one natural and/or plastic yarn, in particular a cotton yarn and/or polyurethane-cotton blended yarn and/or silk yarn and/or polyurethane yarn and/or nylon yarn, in particular consists of at least one such yarn.

According to one embodiment the insert, based on the thickness of the jacket wall, is arranged in its center or closer to an inside or an outside of the jacket wall, wherein in particular an arrangement of the insert between the first quarter and the fourth quarter of the thickness of the jacket wall is provided. Experiments of the applicant have revealed that in case of damage an arrangement of the insert between the first and the second third of the thickness of the jacket wall ensures a retention of the propellant powder; this can also be achieved with a central arrangement and with an arrangement between the second and the third third of the thickness of the jacket wall.

To further simplify the manufacturing process, the insert according to one embodiment can also be arranged directly on an inside of the jacket wall. Then, the felting of the case at the screen need not be interrupted in order to mount the insert. The insert rather is mounted first and felting is started subsequently. In this manufacturing variant, case material is deposited in particular between the meshes of the insert so that the insert is reliably and firmly arranged on the finished case.

In the present case, a cylindrical case also is understood to be a case which is formed circularly cylindrical in the essential part of its longitudinal extension, but towards its bottom and/or its tip has a different, in particular tapering diameter.

BRIEF DESCRIPTION OF DRAWINGS

Further advantages and possible applications of the invention can be taken from the following description in connection with the Figures.

DESCRIPTION OF EXAMPLE ASPECTS AND EMBODIMENTS

Figure 1:
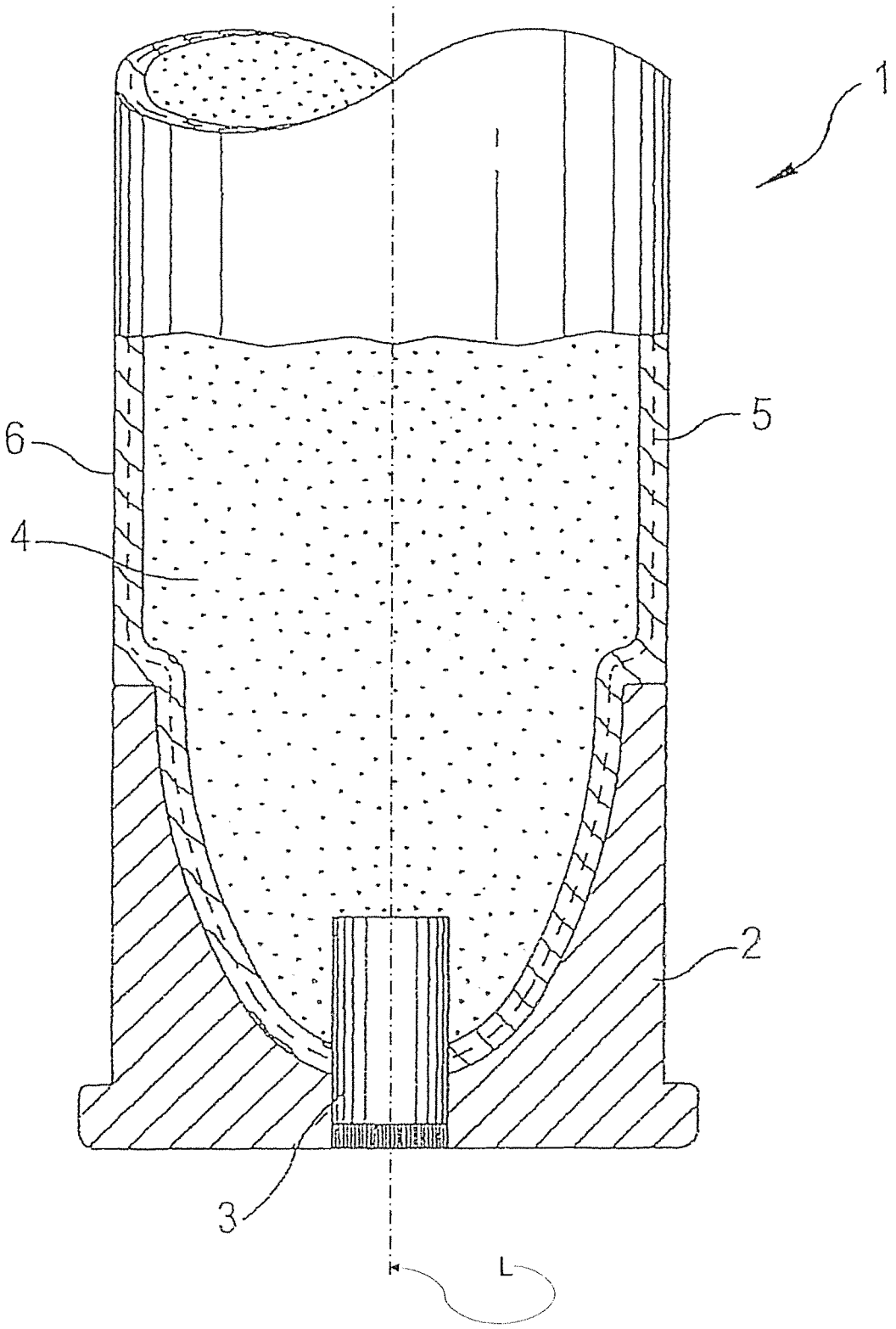
FIG. 1 schematically shows a case comprising an insert according to an exemplary embodiment of the invention as part of a cartridge.

As an exemplary embodiment, FIG. 1 schematically shows a case 6 as part of a cartridge 1. The case is oblong and circularly cylindrical and receives the granular propellant powder 4 in its interior. In the jacket wall of the case 6 an insert 5 according to an embodiment of the invention is embedded. At the lower end of the cartridge 1 a bottom 2 made of brass is mounted with a primer 3.

The case 6 is made of felted cellulose and nitrocellulose fibers as well as conventional additives. The embedded insert 5 is an expandable hose which has been fabricated without seams from a knitwear 12, here by way of example a woven, crocheted and/or knitted fabric. Due to its illustrated embedment into the case 6, its middle axis coincides with the middle axis of the case.

The hose is manufactured from 50% normal cotton yarn and 50% polyurethane-cotton blended yarn, wherein experiments have also revealed a variant with one third of cotton yarn and two thirds of polyurethane-cotton blended yarn as a good material for the hose. In both cases, the blended yarn has a core of polyurethane, which is sheathed with cotton. In the exemplary embodiment, the blended yarn has a composition of 89% cotton and 11% PUR, wherein in different embodiments a PUR content from 5% to 20%, especially between 5% and 20%, is possible.

Due to its formation as knitwear 12, the hose forming the insert is highly stretchable. The stretchability in the axial direction of the case is additionally supported by the polyurethane-cotton blended yarn.

When the case 6 is damaged by mechanical action, so that a crack, a gap or another fracture opening is obtained in the jacket wall, the insert is exposed in the fracture opening and stretched there to such an extent that without tearing it keeps the fracture opening closed against the granular propellant powder in the interior of the case.

At an outside diameter from 50 mm to 170 mm, especially between 50 mm and 170 mm, and a length from 35 cm to 75 cm, especially between 35 cm and 75 cm, a typical case according to the invention has a jacket wall thickness of 1.5 mm to 4 mm, in particular of 2.5 mm. When manufacturing the case, the insert is mounted with a slight elongation of about 10% and in the unstretched state therefore has a diameter of from 40 to 155, especially between 40 and 155 mm.

Figure 2:
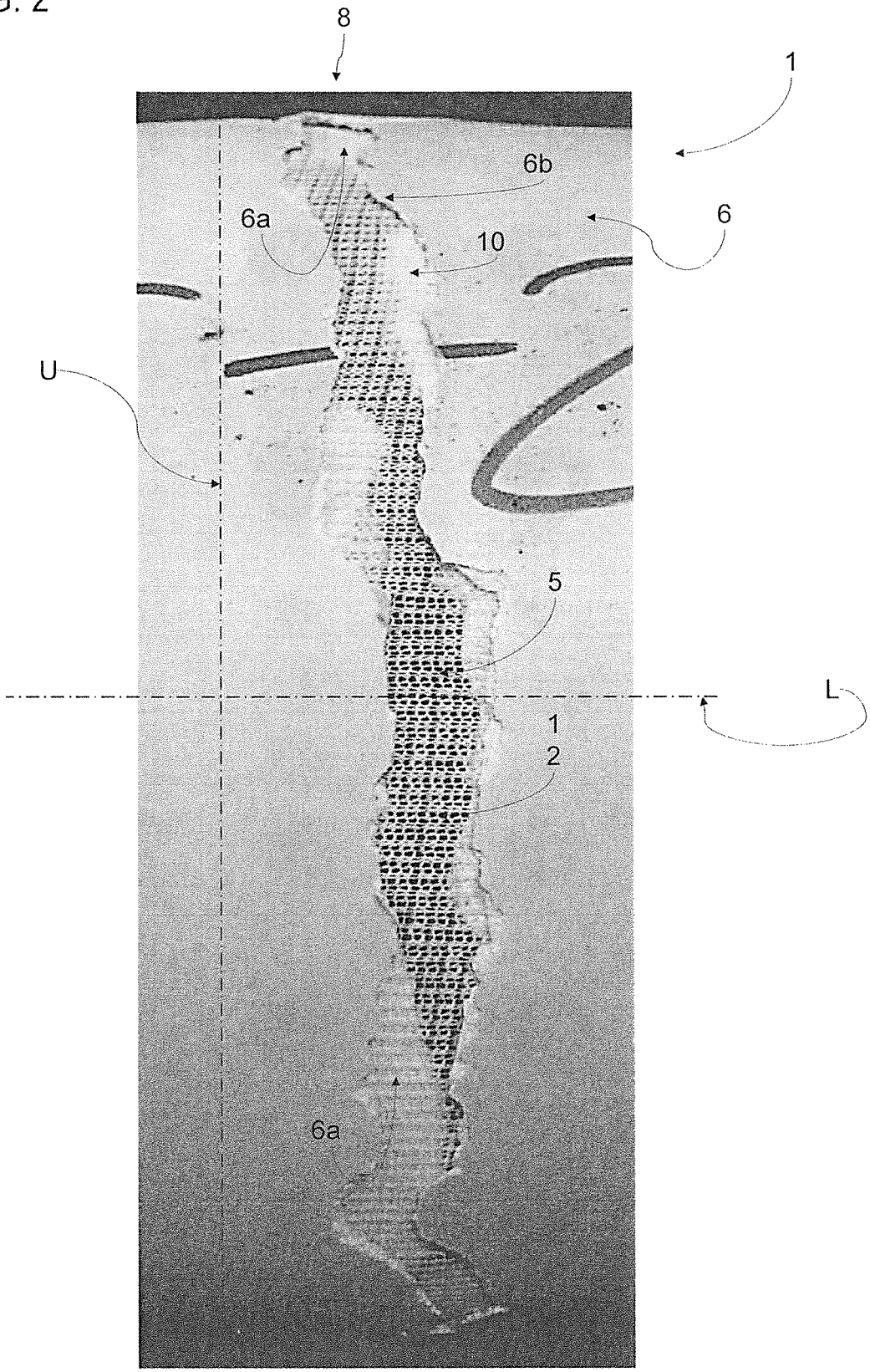
FIG. 2 shows a photo of a case of FIG. 1 after a fracture test with an insert partly exposed in the fracture area.

FIG. 2 shows a photo of a case of FIG. 1 after a fracture test with an insert 5 partly exposed in a fracture area 8. The arrangement of the insert 5 between a radially inner part 6*a* and a radially outer part 6*b* of the case 6 is clearly visible. A felting 10 formed by the meshes of the insert 5 also is partly visible.

The dark lettering on the outer part 6*b* of the case 6 originates from the sample designation of the fracture test carried out and is irrelevant here.

Figure 3:
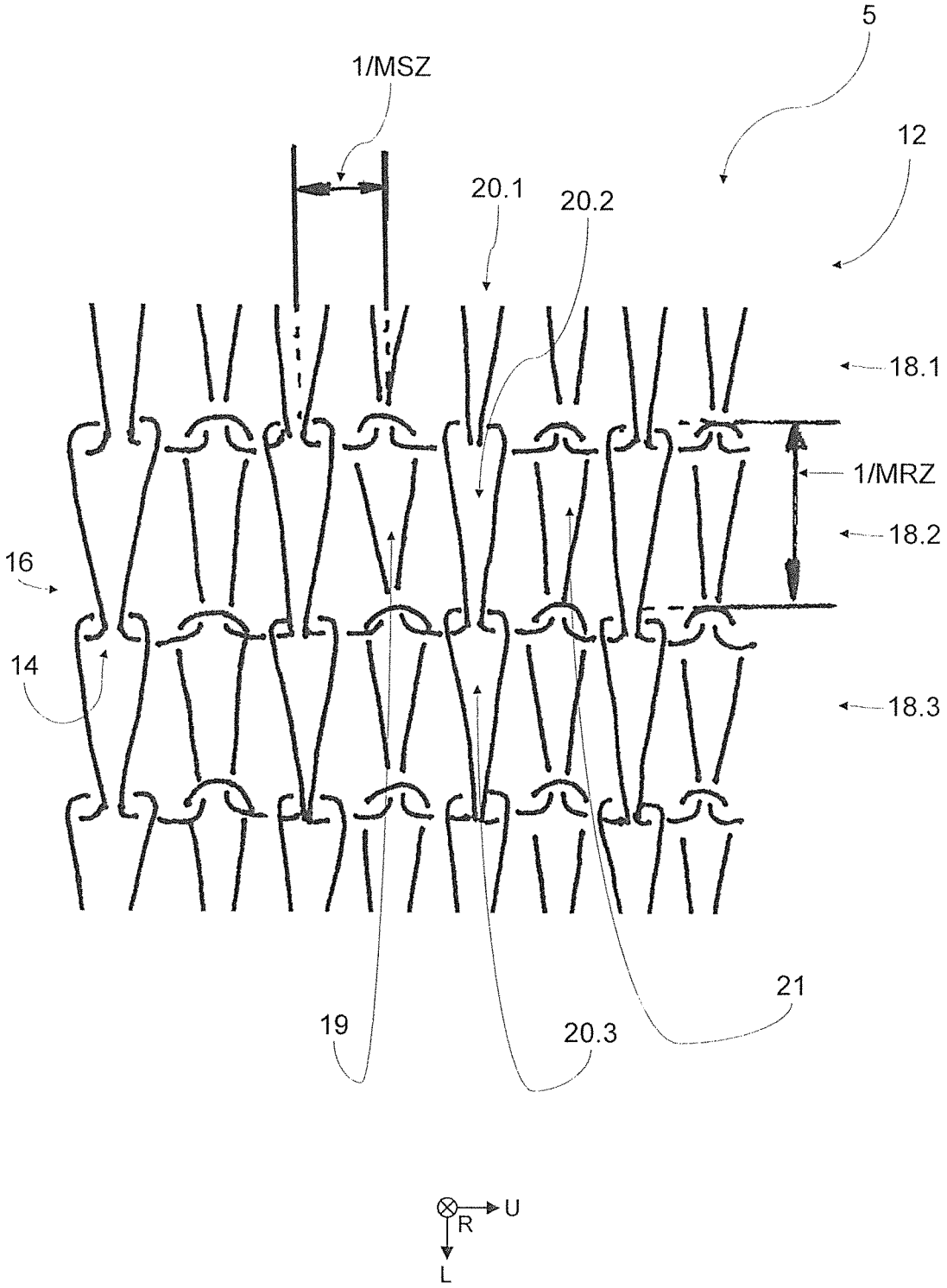
FIG. 3 schematically shows a section of the knitwear which forms the insert of the case of FIGS. 1 and 2.

FIG. 3 schematically shows a section of the knitwear 12 which forms the hose of the insert 5 of the case 6 of FIGS. 1 and 2.

Experiments of the applicant have revealed that the insert 5 as knitwear 12, in particular as woven, crocheted and/or knitted fabric, provides very high strengths and large elongation values at a relatively low weight per unit area and a low radial dimension of the hose. Such textile fabrics are manufactured for example on circular knitting machines. By means of a circular knitting machine, for example a seamless tubular insert like in the illustrated exemplary embodiment can be manufactured.

To provide for very high elongations of the insert 5, a particular mesh weave 14 is used in the exemplary embodiment. A weave image 16 of this mesh weave 14 is shown in FIG. 3.

The weave image 16 sectionally shows a plurality of mesh rows 18, which are arranged one above the other in the vertical direction of the representation of FIG. 3, and a plurality of wales 20, which are arranged one beside the other in the transverse direction of the representation of FIG. 3. In the exemplary embodiment, the vertical direction of the representation of FIG. 3 corresponds to a longitudinal direction L of the insert 5 or the case 6; the transverse direction corresponds to the circumferential direction U of the insert 5 or case 6.

At its lower end, each mesh 20.2 is guided through the corresponding mesh 20.3 of the adjoining lower mesh row 18.3 and in turn guides the corresponding mesh 20.1 of the adjoining upper mesh row 18.1.

The mutually associated meshes 20 of the adjacent mesh rows 18 form a wale 23 and each are guided on the same radial side of the hose of the insert; i.e. either all on the outside or all on the inside.

Adjacent meshes 20 of a mesh row 18 always are guided on the respective other radial side; i.e. when the one adjacent mesh 20 is guided on the inside, the adjacent meshes 19 and 21 each are guided on the outside, and when the one adjacent mesh is guided on the inside, the adjacent meshes each are guided on the inside.

In the exemplary embodiment of the case, from ten to 13 (thirteen), especially between ten and 13 (thirteen), mesh rows per centimeter of longitudinal extension are provided in the knitwear in the unstretched state of the insert (MRZ=number of mesh rows, in FIG. 3 its reciprocal is depicted), in particular from 11.5 to 12, especially between 11.5 and 12, mesh rows. The indication in terms of mesh rows per two centimeters also is common practice: In this case, the insert has a fabric image with from 20 (twenty) to 26 (twenty-six), especially between 20 (twenty) and 26 (twenty-six), mesh rows per two centimeters of longitudinal extension, in particular from 23 to 24, especially between 23 and 24, mesh rows per two centimeters.

With regard to the wales 23, from 10.5 to 13.5, especially between 10.5 and 13.5, wales per centimeter of circumferential extension are provided in the fabric image in the unstretched state of the insert (MSZ=number of wales, in FIG. 3 its reciprocal is depicted), in particular from 11.75 to 12.25, especially between 11.75 and 12.25, wales. The indication in terms of wales per two centimeters also is common practice: In this case, the insert has a fabric image with from 21 (twenty-one) to 27 (twenty-seven), especially between 21 (twenty-one) and 27 (twenty-seven), wales per two centimeters of circumferential extension, in particular from 23.5 to 24.5, especially between 23.5 and 24.5, wales per two centimeters.

In a state mounted on the case, the insert in this exemplary embodiment has a fabric elongation, in particular in the circumferential direction U (or radial direction R) of the case and/or in the longitudinal direction L of the case, of 5% to 20% as compared to the unstretched state, in particular of about 11%. This stretched state also is the stretched state shown in FIG. 2, at least with regard to the order of magnitude, when the slight additional elongation due to the displacement at the fracture point remains neglected.

In the transverse direction of the representation—hence in the circumferential direction U of the hose—the seamless tubular insert 5 used in the exemplary embodiment has a maximum elongation of about 420%. In the vertical direction of the representation—hence in the longitudinal direction L of the hose—the maximum elongation is about 80%. A maximum elongation in the radial direction of the hose of the insert 5 can be calculated from or with the hose diameter in the unstretched state and the maximum elongation in the circumferential direction U of the hose, possibly by taking account of an additional elongation in the longitudinal direction L.

For the material of the insert 5 for example cellulosic fibers can be used, which are used in a single variety (100% cellulosic fibers) or in a fiber blend (for example cotton fibers with a synthetic material such as PUR).

Due to the (actually expert) matching of the fiber thicknesses and the technological parameters of the yarn and knitwear production, the desired felting quality of the case (when felted through the insert) is achieved proceeding from the exemplary embodiment, i.e. it is ensured that the fiber mass gets caught in the "mesh shanks" of the textile and hence prevents a separation or splitting of the case body.

LIST OF REFERENCE NUMERALS

1 cartridge
2 bottom
3 primer
4 propellant powder
5 insert
6 case
6*a* inner part of the case
6*b* outer part of the case
8 fracture area
10 felting
12 knitwear
14 mesh weave
16 weave image
18 mesh row
19, 20, 21 mesh
23 wale
L longitudinal axis/direction
U circumferential direction
R radial direction
MRZ number of mesh rows
MSZ number of wales

What is claimed is:

1. A textile fabric insert (5) configured for being received in a jacket wall of a cylindrical case (6), wherein the case comprises a combustible, felted fibrous material and is adapted for receiving granular propellant powder, wherein the textile fabric is stretchable and includes a knitted, woven and/or crocheted fabric comprising a natural fiber yarn and a natural fiber-plastic blended yarn.

2. The insert according to claim 1, wherein the textile fabric includes only one layer.

3. The insert according to claim 1, wherein the natural fiber yarn is cotton.

4. The insert according to claim 1, wherein the natural fiber-plastic blended yarn comprises polyurethane.

5. The insert according claim 1, wherein the natural fiber yarn comprises a proportional yarn content and/or a weight content of 30% to 50% in the textile fabric and/or the natural fiber-plastic blended yarn-comprises a proportional yarn content and/or a weight content of 50% to 70% in the textile fabric.

6. The insert according to claim 5, wherein the proportions of natural fiber yarn and natural fiber-plastic blended yarn are 50/50.

7. The insert according claim 1, wherein the natural fiber-plastic blended yarn has a content of natural fiber from 70% to 95% and/or a content of plastic fiber from 5% to 30%.

8. The insert according to claim 7, wherein the proportions of natural fiber to plastic fiber are 89/11.

9. The insert according to claim 1, wherein the insert (5) is formed as a hose.

10. The insert according to claim 9, wherein in an unstretched state the hose has a diameter in the range from 40 mm to 155 mm.

11. The insert according to claim 9, wherein the hose is seamless.

12. The insert according to claim 9, wherein the insert (5) is formed as a single layer and is both axially and radially stretchable.

13. The insert according to claim 9, wherein in the circumferential direction (U) of the hose the fabric has a maximum elongation of about 420%.

14. The insert according to claim 9, wherein in the longitudinal direction (L) of the hose the fabric has a maximum elongation of about 80%.

15. The insert according to claim 1, wherein the textile fabric comprises mutually associated meshes (20) and adjacent mesh rows (18), wherein the mutually associated meshes (20) of the adjacent mesh rows (18) each are guided on the same radial side of the hose of the insert.

16. The insert according to claim 15, wherein the adjacent meshes (20) of a mesh row (18) are guided only on different radial sides.

17. The insert according to claim 1, wherein the textile fabric has a mesh row density (MRZ) in the range from 10 to 13 mesh rows per centimeter.

18. The insert according to claim 1, wherein the fabric has a wale density (MSZ) or a mesh density in the range from 10.5 to 13.5 meshes or wales per centimeter.

* * * * *